US006213599B1

(12) United States Patent
Sung et al.

(10) Patent No.: US 6,213,599 B1
(45) Date of Patent: Apr. 10, 2001

(54) INK-JET CARTRIDGE FOR AN INK-JET PRINTING APPARATUS

(75) Inventors: Wen-kang Sung; Ji-chen Wu; Hsien-shu Tsai, all of Hsinchu (TW)

(73) Assignee: Wisertek International Corporation (TW)

( * ) Notice: Subject to any disclaimer, the term of this patent is extended or adjusted under 35 U.S.C. 154(b) by 0 days.

(21) Appl. No.: 09/465,000

(22) Filed: Dec. 16, 1999

(30) Foreign Application Priority Data

Aug. 17, 1999 (TW) ..... 88214037

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS 5,877,794 * 3/1999 Takagi ..... 347/87
5,886,721 * 3/1999 Fujii et al. ..... 347/87
6,082,852 * 7/2000 Soga et al. ..... 347/86

* cited by examiner

*Primary Examiner*—N. Le
*Assistant Examiner*—Anh T. N. Vo

(57) ABSTRACT

An ink cartridge for an ink jet printing device includes a rigid body having an ink chamber for containing ink within the body and an ink output port at one end of the body such that the ink within the ink chamber is output from the output port. A porous transmit medium is placed within the ink chamber and has one end adjacently connected to the ink output port such that the ink within the ink cavity is transmitted to the ink output cavity from the transmit medium by capillary action. The porous transmission medium is in an n-shaped form, including an input end, an output end, and an impermeable sheath between the input end and the output end. Thus, in the process of ink jet printing, at the instant when the ink within the ink output port is ejected, the porous transmit medium transmits the ink to the ink output chamber. As a result, no leakage of ink and smooth ink delivery are achieved. In addition, the structure of the cartridge is simple and assembly is early. The cartridge does not occupy space of the ink chamber.

7 Claims, 2 Drawing Sheets

INK-JET CARTRIDGE FOR AN INK-JET PRINTING APPARATUS

FIELD OF THE INVENTION

The present invention relates to an ink-jet cartridge for an ink-jet printing apparatus, and in particular, to an ink-jet cartridge employing a porous transmission medium to transmit ink.

BACKGROUND OF THE INVENTION

A conventional ink-jet cartridge is provided with or mounted on an ejecting device. By means of the ejecting device, the ink within the ink-jet cartridge is ejected and printed onto a substrate. However, in order to stably deliver ink with no ink leakage in the ink-jet printing process by the ejecting device, a negative pressure regulating device and an air filling unit are provided within the ink-jet cartridge, for example, as disclosed in U.S. Pat. Nos. 5,409,134 and 5,541,632. This way provides smooth ink delivery without ink leakage, but an additional negative pressure regulating device and an air filling unit are provided. The structures disclosed in these prior art patents are rather complicated and the precision thereof must be quite high. Therefore, its production cost is relatively high.

Another conventional ink-jet cartridge is provided with an absorptive material, such as a sponge, to prevent ink leakage However, in this conventional ink-jet cartridge, the entire room within the inkjet cartridge has to be filled with a sponge in order to obtain a good effect of zero ink leakage. Only 60% of the ink within the conventional ink-jet cartridge can be ejected and the remaining ink is kept by the sponge and cannot be ejected. Therefore, it becomes a waste of material.

SUMMARY OF THE INVENTION

It is accordingly an object of the present invention to provide an ink-jet cartridge for an ink-jet printing apparatus that achieves the effect of smooth ink delivery and zero ink leakage during printing.

Another object of the invention is to provide an ink-jet cartridge for an ink-jet printing apparatus, wherein the inkjet cartridge is simple in structure and easy to assemble. In addition, substantially all the ink within the ink-jet cartridge is ejectable for printing.

To achieve the above objects, the ink-jet cartridge for an ink-jet printing apparatus in accordance with the invention comprises a rigid body having an ink reservoir for holding ink within the rigid body and an ink output port at one end of the body so that the ink within the ink reservoir is ejected from the output port; and a porous transmission medium disposed within the ink reservoir of the rigid body, having one end connected to the ink output port so that the ink within the ink reservoir is transmitted to the ink output port through the transmission medium by the capillary action.

Thus, in the process of ink-jet printing, when the ink is ejected through the ink output port, the porous transmission medium transmits ink from the ink reservoir to the ink output port. Thereby, the effects of no ink leakage and smooth ink delivery can be obtained. In addition, the ink-jet cartridge is simple in structure and easy to assemble. The ink-jet cartridge occupies only little of the space within the ink reservoir and the major portion of the ink can be ejected for printing.

BRIEF DESCRIPTION OF THE DRAWINGS

These and other objects and advantages of the present invention will become apparent by reference to the following description and accompanying drawings wherein.

DETAILED DESCRIPTION OF THE PREFERRED EMBODIMENT

Figure 1:
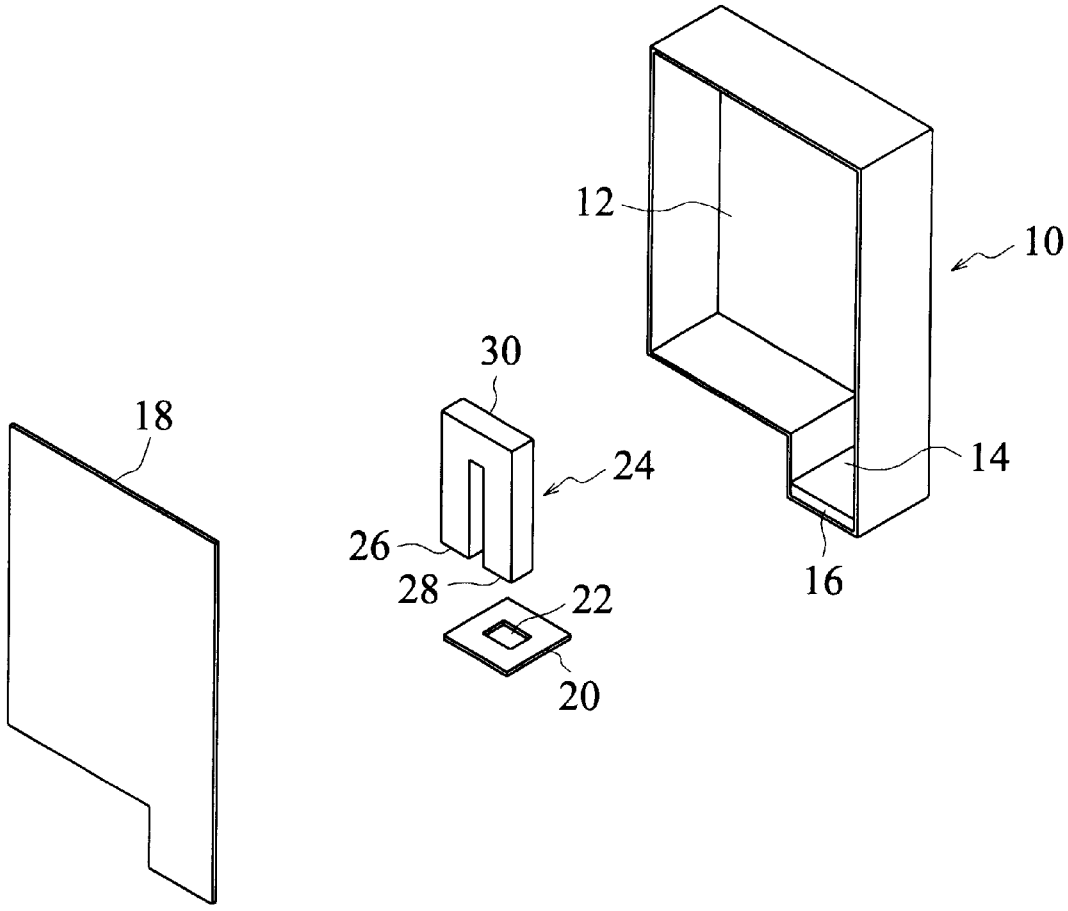
FIG. 1 is an exploded view of the ink-jet cartridge for an ink-jet printing apparatus in accordance with a preferred embodiment of the invention.

Referring to FIG. 1, an ink-jet cartridge for an ink-jet printing apparatus in accordance with the invention comprises a rigid body 10. An ink reservoir 12 is formed within the rigid body 10 for holding ink. An ink output port 14 is disposed at one end of the rigid body 10 and an ejecting device 16 is disposed at one end of the ink output port 14 so that the ink within the ink reservoir 12 is output through the output port 14. A cover plate 18 seals the ink reservoir 12.

A mounting plate 20 is disposed between the ink reservoir 12 and the ink output port 14, and a mounting hole 22 is formed in the mounting plate 20.

A porous transmission medium 24 is disposed within the ink reservoir 12 of the rigid body 10 having one or more bends. In accordance with a preferred embodiment of the invention, the porous transmission medium 24 is an n-shaped structure, including two transmission ends wherein one is an input end 26 and the other is an output end 28. The output end 28 is adjacent to the ink output port 14 and is mounted in the mounting hole 22 in the mounting plate 20. The porous transmission medium 24 is a sponge, a non-woven material, or the like, and the ink within the ink reservoir 12 is transmitted into the ink output port 14 via the input end 26 and the output end 28 by the capillary action. An impermeable sheath 30 is formed between the input end 26 and the output end 28 so that the ink can only be transmitted into the ink output port 14 from the input end 26 to the output end 28 by the capillary action. The porous transmission medium 24 and the ink do not generate chemical reaction that may incur the corrosion or damage of the porous transmission medium 24.

Figure 2:
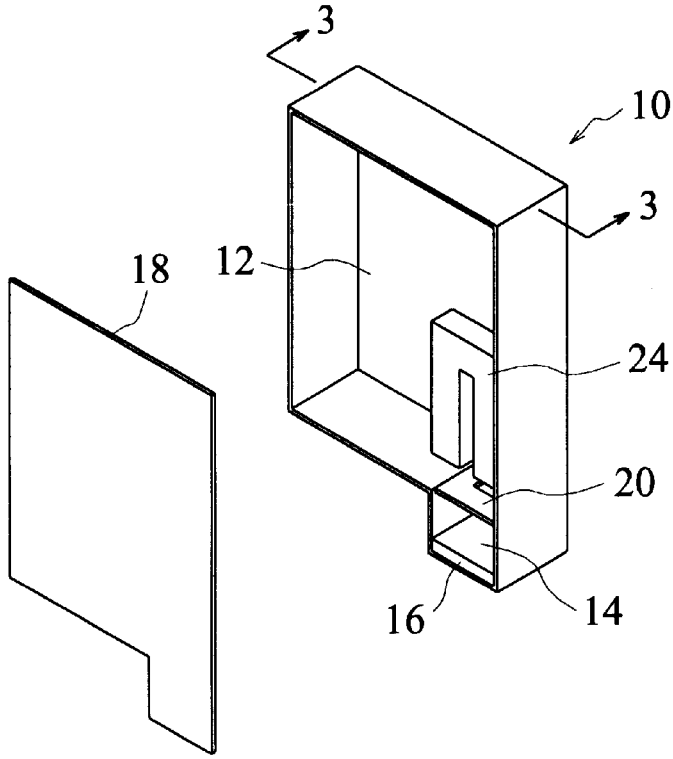
FIG. 2 is a view showing a porous transmission medium disposed within the ink reservoir of the ink-jet cartridge of the invention.

Referring to FIG. 2, the mounting plate 20 is first mounted in between the ink reservoir 12 and the ink output port 14, and the output end 28 of the porous transmission medium 24 is then disposed in the mounting hole 22 of the mounting plate 20. The cover plate 18 seals the ink reservoir 12 of the rigid body 10 to form a closed space so that no ink leakage occurs when ink is injected into the ink reservoir 12.

Figure 3:
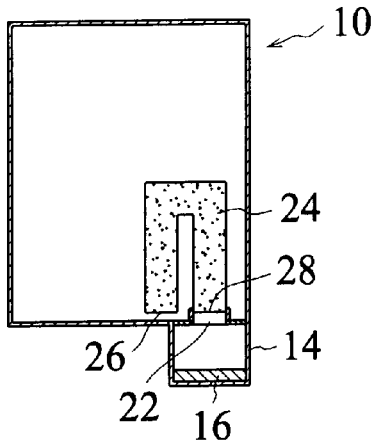
FIG. 3 is a sectional view taken along the line 3—3 of FIG. 2.

Referring to FIGS. 2 and 3, in the process of ink-jet printing, the ink within the ink output port 14 is ejected by the ejecting device 16 and the pressure within the ink output port 14 decreases. At this time, the ink in the ink reservoir 12 is transmitted from the input end 26 to the output end 28 through the porous transmission medium 24 by the capillary action in order to supply ink into the ink output port 14. Thereby, the ink-jet cartridge achieves the effects of no ink leakage and smooth ink delivery. In addition, the inkjet cartridge is simple in structure and easy to assemble. The porous transmission medium 24 occupies only a little of the space within the ink reservoir and the major portion of the ink can be ejected for printing. This avoids the disadvantage of the ink incapable of being fully utilized of a conventional ink reservoir that is entirely occupied by a sponge.

While the invention has been described by way of example and in terms of a preferred embodiment, it is to be understood that the invention is not limited to the disclosed embodiment. To the contrary, it is intended to cover various modifications. Therefore, the scope of the appended claims should be accorded the broadest interpretation so as to encompass all such modifications.

What is claimed is:

1. An ink-jet printing apparatus comprising:

a rigid body having an ink reservoir for holding ink within the rigid body and an ink output port at one end of the rigid body for electing ink within the ink reservoir from the output port; and a porous transmission medium disposed within the ink reservoir of the rigid body having one end adjacent to the ink output port so that the ink within the ink reservoir is adapted to be transmitted to the ink output port through the porous transmission medium by capillary action; wherein the porous transmission medium is in an n-shaped form, including an input end, an output end, and an impermeable sheath between the input end and the output end.

2. The ink-jet cartridge for an ink-jet printing apparatus according to claim 1, wherein the ink output port of the rigid body is provided with an ejecting device to eject the ink within the output port.

3. The ink-jet cartridge for an ink-jet printing apparatus according to claim 1, wherein the porous transmission medium is a sponge.

4. The ink-jet cartridge for an ink-jet printing apparatus according to claim 1, wherein the porous transmission medium is provided with at least one bend.

5. The ink-jet cartridge for an ink-jet printing apparatus according to claim 1, wherein the porous transmission medium substantially does not generate any chemical reaction with the ink.

6. The ink-jet cartridge for an ink-jet printing apparatus according to claim 1, wherein the porous transmission medium is made of a non-woven absorption material.

7. The ink-jet cartridge for an ink-jet printing apparatus according to claim 1, further comprising a mounting plate disposed between the ink reservoir and the ink output port and the porous transmission medium is attached to the mounting plate.

* * * * *